United States Patent [19]

Zimmerman

[11] 4,068,771

[45] Jan. 17, 1978

[54] CARRIER BUCKET AND APPARATUS FOR REMOVABLY ATTACHING THE SAME TO A LOADER BUCKET

[76] Inventor: James Eldon Zimmerman, 600 Manatee Ave. W., Holmes Beach, Fla. 33577

[21] Appl. No.: 733,218

[22] Filed: Oct. 18, 1976

[51] Int. Cl.[2] ..... E02F 3/81

[52] U.S. Cl. ..... 214/313; 37/117.5; 214/145 R

[58] Field of Search ..... 214/130 B, 131 R, 140, 214/145 R, 145 A, 146 R, 307, 312, 313, 314, 620, 621, 703, 740, 767; 37/117.5, DIG. 3, DIG. 12; 294/68, 73; 222/176; 296/39 R; 298/1 A

[56] References Cited

U.S. PATENT DOCUMENTS

| | | | |
|---|---|---|---|
| 642,171 | 1/1900 | Suppes | 294/68 |
| 1,937,668 | 12/1933 | Pine | 214/312 X |
| 2,712,797 | 7/1955 | Woehrle et al. | 296/39 R |
| 3,286,861 | 11/1966 | Ehrhorn | 214/314 |
| 3,318,486 | 5/1967 | Felix | 222/176 X |
| 3,348,715 | 10/1967 | Kretz | 214/620 X |
| 3,598,266 | 8/1971 | Fisher | 214/145 R X |

FOREIGN PATENT DOCUMENTS

| | | | |
|---|---|---|---|
| 444,026 | 10/1926 | Australia | 214/314 |
| 1,182,259 | 11/1964 | Germany | 294/73 |

*Primary Examiner*—L. J. Paperner

*Attorney, Agent, or Firm*—Tilton, Fallon, Lungmus & Chestnut

[57] ABSTRACT

A carrier bucket is attachable to a loader bucket in such a manner that it can quickly and easily be attached to the loader bucket in the field by adjustable side linkages for carrying concrete or the like. The bottom, sides and back walls of the carrier bucket conform to the shape of the loader bucket so that when the carrier bucket is assembled to the loader bucket, the strength of the loader bucket not the carrier bucket is used to hold the contents. The front wall of the carrier bucket is bowed outwardly at the center, and is provided with a metering gate and spout.

3 Claims, 4 Drawing Figures

CARRIER BUCKET AND APPARATUS FOR REMOVABLY ATTACHING THE SAME TO A LOADER BUCKET

BACKGROUND AND SUMMARY

The present invention relates to apparatus useful in combination with a conventional front-end loader for converting the same to permit it to carry flowable material, such as concrete.

In pouring concrete, there is a need to specifically direct the concrete to a particular location. This is frequently done through the use of trucks which are provided with troughs. Frequently, it is difficult to position a concrete truck directly at the sight where it is desired to pour the concrete. This is because a typical construction site is not grated properly for drainage, and the extreme weight of a loaded or partially loaded concrete truck would cause it to get stuck. This is particularly true considering the modern trend toward heavier concrete trucks.

In cases where a concrete truck cannot get at the site where the concrete is to be used, troughs may be used to route the concrete from the truck to the site, but frequently it is required that the concrete be transported by wheelbarrow. This is not only costly from the viewpoint of labor expenditure, but it is time consuming at a critical time during concrete set, and it may cause a portion of the concrete load to be rendered unfit for use due to partial curing.

There are, at most construction sites, particularly at the larger sites where large quantities of concrete are used, front end loaders. These are traction vehicles (either rubber tired or crawler type) which are provided with a bucket and mechanism for lifting and tilting the bucket.

Front end loaders are particularly useful for scooping dirt or material and loading it into a truck. They are particularly mobile in conditions of adverse terrain, and I have found that because of their capacity, power and mobility, front end loaders can be very efficient in transporting and pouring concrete when provided with the apparatus of the present invention.

Heretofore, front end loaders have not gained commercial acceptance as concrete carriers, although suggestions have been made to convert loader buckets to various uses, as in U.S. Pat. Nos. 3,598,266; 3,897,641 and 3,208,610. One of the disadvantages of prior art suggestions to modify loader buckets to carry concrete is that elements had to be permanently or semi-permanently attached to the loader bucket, requiring holes to be drilled into the loader bucket for bolts or the like. These have the disadvantage that the loader is not available for more general usage, whereas in the present invention, a loader is readily and conveniently adapted for use as a concrete carrier and it is easily disassembled for general usage. Further, in those cases of prior art which require rotatable elements, such construction would be unsuited for use in contact with concrete which, if it hardened on bolts or nuts, would make it extremely difficult to disassemble the bolts or to permit pivoting motion, as is required in some prior art suggestions.

Briefly, the present invention includes a carrier bucket which is attachable to a loader bucket and held within the loader bucket. The bottom, sides and back walls of the carrier bucket conform to the shape of the loader bucket so that the strength of the loader bucket carries the load, not the carrier bucket. Further, the attachment mechanism is completely exterior to both the loader bucket and the carrier bucket. Hence, the attachment mechanism does not contact the contents of the carrier bucket; and the attaching mechanism facilitates quick and easy attachment or removal of the carrier bucket.

The carrier bucket is bowed outwardly at the front center to both funnel the contents to a metering gate and to reduce stress on the front wall when the contents are being dispensed. A metering gate and spout are also provided for directing the contents of the carrier bucket to a particular application site.

Other features and advantages of the present invention will be apparent to persons skilled in the art from the following detailed description of a preferred embodiment accompanied by the attached drawing wherein identical reference numerals will refer to like parts in the various views.

THE DRAWING

DETAILED DESCRIPTION

Figure 1:
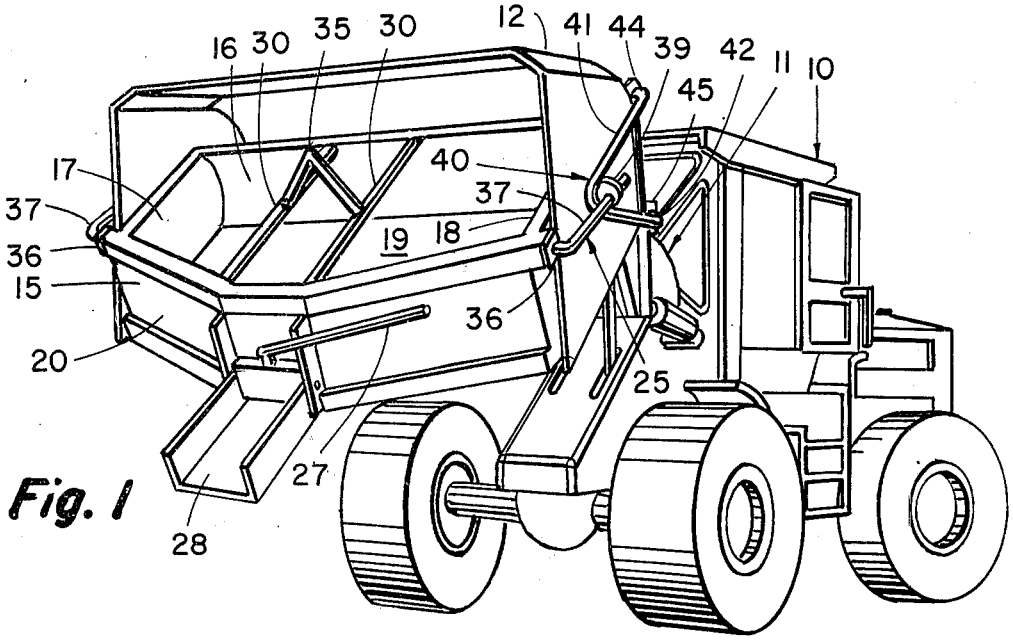
FIG. 1 is a front perspective view of a front end loader incorporating the present invention.

Referring to FIG. 1, reference numeral 10 generally designates a front end loader. The loader 10 of the illustration is a wheel loader, being provided with rubber tires; but the present invention is equally well adaptable to loaders of the crawler or continuous track type.

The loader 10 includes a lifting and tilting mechanism generally designated 11 which holds a loader bucket 12 and is capable of lifting and independently tilting the loader bucket 12.

Figure 2:
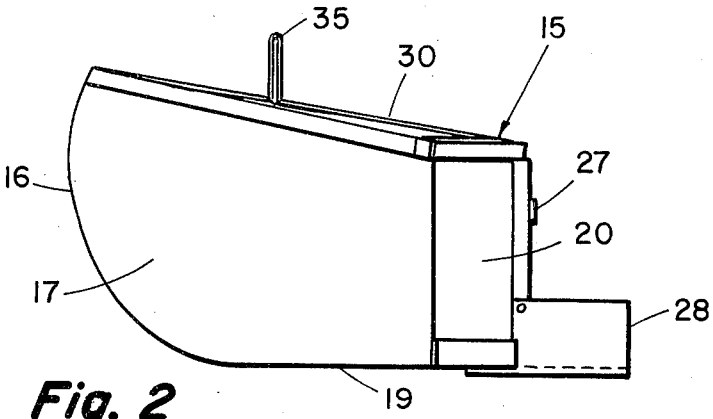
FIG. 2 is a side view of the removable carrier bucket.

A carrier bucket generally designated by reference numeral 15 is received in the loader bucket 12, and it includes a rear wall 16, first and second side walls 17 and 18, a bottom 19, and a front wall 20. As seen best in FIG. 2, the back wall 16 is curved and forms a continuous piece with the bottom wall 19. The curvature of the back wall and bottom wall is such as to conform the shape of the carrier bucket 15 to that of the loader bucket 12. This is important because it enables the carrier bucket to be made from a lighter gauge metal so that the weight of the contents of the carrier bucket is supported primarily by the loader bucket 12, which is designed for heavy loads.

The carrier bucket 15 may, for example, be formed from 10-gauge metal. The sides 17, 18 of the carrier bucket also conform to the sides of the loader bucket 12, but the upper forward portions of the sides 17, 18 extend outwardly beyond the mouth of the loader bucket for securing the adjustable attaching linkages 25 which removably secure the carrier bucket in the loader bucket.

It will be observed from FIG. 1 that the front wall 20 of the carrier bucket is bowed outwardly at its center and that a metering gate 26, provided with a handle 27 is located at the center of the front wall 20. A pouring spout 28 is provided beneath the metering gate 26.

A pair of bars 30 extend between the back wall 16 and the front wall 20 of the carrier bucket; and a latch bar 35, of inverted V-shape, is secured between the bars 30 and extends above them to provide a location to which a line or hook may be secured to the carrier bucket for transporting it.

Figure 3:
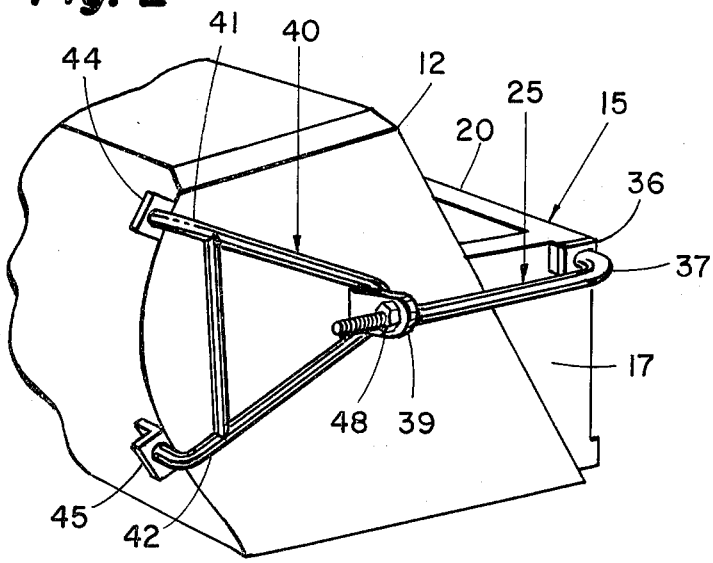
FIG. 3 is a fragmentary rear perspective view of the loader bucket and concrete bucket in assembled relation.
Figure 4:
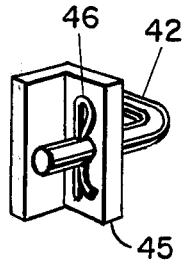
FIG. 4 is a close-up view illustrating the manner in which the attaching linkage for the carrier bucket is removably secured to the loader bucket.

Referring now to FIG. 3, the right side adjustable connecting linkage 25 is shown, and it will be appreciated that a similar linkage is provided on the other side to secure the carrier bucket to the loader bucket. A mounting block 36 is welded to the side wall 17 of the carrier bucket, adjacent the upper forward portion thereof; and a J-shaped rod 37 is secured at one end to the mounting block 36, and it is threaded at the other end. The threaded end of the rod 37 is received through an aperture in a tab 39. The tab 39 is welded or otherwise secured to a A-shaped link 40, the feet of which are turned inwardly behind the back of the loader bucket 12, as at 41 and 42, where they are received in apertures in angle-iron brackets 44, 45 respectively. The brackets 44, 45 are welded to the back of the loader bucket 12, and permanently attached thereto. The bent ends 41, 42 of the A-shaped link 40 are provided with transverse apertures for receiving pins, such as the one shown in FIG. 4 and designated 46 for securing the link to the bucket in a manner which facilitates quick assembly or removal.

The J-shaped rod 37 is secured to the bracket 39 by means of a nut 48 on the threaded portion of the rod. Hence, the carrier bucket is quickly and conveniently assembled to the loader bucket by an adjustable linkage mechanism.

It will be appreciated that none of the connecting mechanism contacts the concrete inside the carrier bucket, and this has the advantage of keeping the parts which must be assembled and disassembled free from concrete.

Having thus described in detail a preferred embodiment of the invention, persons skilled in the art will be able to modify certain of the structure which has been illustrated and substitute equivalent elements for those disclosed while continuing to practice the principle of the invention; and it is, therefore, intended that all such modifications and substitutions be covered as they are embraced within the spirit and scope of the appended claims.

I claim:

1. Apparatus for removable attachment to a loader bucket for converting the loader bucket to carry flowable material comprising a carrier bucket having upright first and second side walls, a rear wall and a front wall, and a bottom interconnecting all of said walls, said carrier bucket being formed to be received in said loader bucket, the rear wall, first and second side walls and bottom wall of said carrier bucket conforming to the shape of said loader bucket, first and second attaching means for removably securing the exterior of said first and second side walls of said carrier bucket to said loader bucket, said first and second attaching means each comprising a linkage assembly secured to a side wall of said carrier bucket adjacent the forward portion thereof and extending rearwardly therefrom, and bracket means secured to the rear wall of said loader bucket and adapted to receive the rear portion of said linkage means.

2. The apparatus of claim 1 wherein said linkage means comprises a block secured to the side wall of said carrier bucket, a rearwardly extending rod having its forward end secured to said mounting block and its rearward end threaded, and A-shaped link provided with a tab received over the threaded portion of said first rod, the leg portions of said A-shaped link being turned inwardly behind said loader bucket when said carrier bucket is assembled thereto, and first and second brackets secured to the rear of said loader bucket and adapted to receive the inwardly bent portions of said A-shaped link.

3. The apparatus of claim 2 further comprising pin means for securing the distal ends of said A-shaped link to said brackets.

* * * * *